US009345096B2

(12) United States Patent
Nieberlein et al.

(10) Patent No.: US 9,345,096 B2
(45) Date of Patent: May 17, 2016

(54) LED LIGHTING APPARATUS WITH COLOUR MIXING

(71) Applicant: Diehl Aerospace GmbH, Ueberlingen (DE)

(72) Inventors: Uwe Nieberlein, Roth (DE); Jens Jordan, Nuremberg (DE)

(73) Assignee: DIEHL AEROSPACE GMBH, Ueberlingen (DE)

( * ) Notice: Subject to any disclaimer, the term of this patent is extended or adjusted under 35 U.S.C. 154(b) by 0 days.

(21) Appl. No.: 14/687,270

(22) Filed: Apr. 15, 2015

(65) Prior Publication Data

US 2015/0296588 A1 Oct. 15, 2015

(30) Foreign Application Priority Data

Apr. 15, 2014 (DE) ..... 10 2014 005 583

(51) Int. Cl.
*H05B 37/02* (2006.01)
*H05B 33/08* (2006.01)

(52) U.S. Cl.
CPC ..... *H05B 33/0857* (2013.01); *H05B 33/0809* (2013.01); *H05B 33/0824* (2013.01); *H05B 37/02* (2013.01)

(58) Field of Classification Search
CPC ..... H05B 33/0827; H05B 37/02
USPC ..... 315/185 R, 192, 291, 307, 308
See application file for complete search history.

(56) References Cited

U.S. PATENT DOCUMENTS

| | | | | |
|---|---|---|---|---|
| 8,581,521 | B2 * | 11/2013 | Welten | H05B 33/083 315/113 |
| 9,113,528 | B2 * | 8/2015 | Bora | H05B 33/0863 |
| 2009/0015172 | A1 | 1/2009 | Huang et al. | |
| 2010/0090607 | A1 | 4/2010 | Vos | |
| 2012/0056545 | A1 * | 3/2012 | Radermacher | H05B 33/0818 315/152 |
| 2013/0257300 | A1 | 10/2013 | Nieberlein et al. | |
| 2013/0257310 | A1 | 10/2013 | Nieberlein et al. | |

FOREIGN PATENT DOCUMENTS

| | | | |
|---|---|---|---|
| DE | 102012006315 | A1 | 10/2013 |
| DE | 102012006316 | A1 | 10/2013 |
| DE | 102012006341 | A1 | 10/2013 |
| DE | 102012006343 | A1 | 10/2013 |
| WO | 2010/027254 | A1 | 3/2010 |
| WO | WO 2011/081748 | A1 | 7/2011 |

* cited by examiner

*Primary Examiner* — Tung X Le
(74) *Attorney, Agent, or Firm* — Scully, Scott, Murphy & Presser, P.C.

(57) ABSTRACT

In comparison with thermal light sources, LED lighting has the advantage that it is very small and at the same time commercially available in different colors, so that colored lighting can be produced inexpensively and at the same time in a manner that saves installation space. It is an object of the present invention to equip an LED lighting apparatus with a color mixing functionality that is distinguished by high efficiency and at the same time a small number of components.

15 Claims, 4 Drawing Sheets

LED LIGHTING APPARATUS WITH COLOUR MIXING

BACKGROUND OF THE INVENTION

The invention relates to an LED lighting apparatus with colour mixing and a method for operating the LED lighting apparatus.

DISCUSSION OF THE PRIOR ART

In comparison with thermal light sources, LED lighting has the advantage that it is very small and at the same time commercially available in different colours, so that coloured lighting can be produced inexpensively and at the same time in a manner that saves installation space. One area of application of coloured lighting is interior lighting, such as in the case of an aircraft. In this instance, coloured lighting can implement ambient lighting, with different lighting colours being able to be chosen on the basis of the time of day, for example.

Particularly in the case of aircraft, the onboard power supply system provides AC power supplies. Since operation of LEDs is firstly not possible using AC voltage and secondly standard switched-mode power supplies have a high level of equipment complexity, the patent applications DE 10 2012 006 315 A1, DE 10 2012 006 316 A1, DE 10 2012 006 341 A1 and DE 10 2012 006 343 A1 describe LED arrangements that each have a plurality of LEDs, the LEDs being able to be connected up to one another flexibly, so that the LEDs altogether can provide different on-state voltages. These LED arrangements are supplied with a rectified AC voltage as supply voltage, wherein a control device ensures that the LED arrangement assumes a switching state that corresponds to a present voltage of the supply voltage. In this way, it is possible for the LED arrangement to be operated on an AC power supply using a rectifying circuit, but without a switched-mode power supply. The applications also mention that the LEDs can have different colours.

SUMMARY OF THE INVENTION

It is an object of the present invention to equip an LED lighting apparatus with a colour mixing functionality that is distinguished by high efficiency and at the same time a small number of components.

The invention proposes an LED lighting apparatus that is suitable and/or designed for lighting an interior. Particularly preferably, the LED lighting apparatus is designed for lighting a passenger space in an aircraft. Optionally, an aircraft having one or more such LED lighting apparatuses forms a further subject matter of the invention.

The LED lighting apparatus comprises a colour mixing unit, wherein the colour mixing unit has at least a first and a second colour group of LEDs. LEDs are understood to mean light-emitting diodes. The colour mixing unit is preferably in the form of a functional unit, wherein the LEDs in the at least two colour groups are preferably in an arbitrarily distributed arrangement on a surface. The LEDs in the colour groups differ from one another on the basis of colour group by virtue of their light colour. Thus, one colour group may have exclusively green LEDs, another colour group may have exclusively red LEDs and another colour group may have exclusively blue LEDs. Preferably, each of the colour groups has exclusively LEDs in one light colour. Further light colours, such as orange colours or white, are likewise possible. Each colour group preferably contains at least five, particularly at least ten, LEDs.

The LED lighting apparatus has a power supply that is designed to supply the colour mixing unit with a supply voltage. The supply voltage is in the form of a rectified AC voltage. Particularly preferably the LED lighting apparatus is designed for an AC power supply. By way of example, the AC power supply may be a public electricity grid with an RMS mains voltage of 230 volts and a mains frequency of 50 hertz. Particularly preferably, the AC power supply has an RMS voltage of between 100 and 150 volts, particularly 115 volts, and a mains frequency of between 100 hertz and 800 hertz, particularly between 150 hertz and 400 hertz. Particularly preferably, the AC power supply is provided in the aircraft. The power supply can comprise a rectifier device that rectifies the AC voltage of the AC power supply to produce the rectified AC voltage as a supply voltage with a supply current. By way of example, the rectifier device may be a bridge circuit. The AC voltage is particularly preferably in the form of sinusoidal voltage, and in alternative embodiments it may also be a distorted sinusoidal voltage or another alternating AC voltage. The supply voltage as a rectified AC voltage is particularly in a form with regularly repeating, preferably sinusoidal half-cycles. The repetition rate of the half-cycles of the supply voltage defines a voltage frequency. In particular, the voltage frequency of the supply voltage is twice as high as the frequency of the AC voltage of the AC power supply, since the latter is produced by "upturning" the negative half-cycles.

The LED lighting apparatus comprises a control device for selectively activating and deactivating the colour groups, wherein the colour mixing unit produces a mixed colour, particularly for a human user, by virtue of the selectively activated and deactivated colour groups. The mixed colour is particularly preferably in the form of a static or more or less static mixed colour, with the mixed colour changing at a frequency of less than 10 hertz, preferably less than 1 hertz.

The invention defines a colour time window that is repeated at a colour mixing frequency. The colour time window is a descriptive tool for the temporal response of the LED lighting apparatus. The control device is designed to actuate the colour groups such that they are activated within the colour time window in succession in order to produce the mixed colour during the colour time window. Within a colour time window, the colour groups are therefore activated in succession in order to produce the mixed colour. A colour time window therefore precisely describes a pass of all of the colour groups of the colour mixing unit over time. In other words, a colour time window begins when the first colour group is activated and ends at the instant of deactivation of the last colour group. The colour time window thus precisely describes the period for which all of the colour groups of the colour mixing unit were activated precisely once. One or more colour time windows define a colour period. In particular, a colour period comprises precisely one colour time window.

In this context, it is a consideration of the invention that a mixed colour can be produced, particularly for the human observer, by simultaneously activating LEDs with different light colours. However, an alternative, and in this case inventive, possibility is for LEDs in different colour groups to be alternatively activated and deactivated in rapid succession so as in this way to produce the mixed colour, particularly for the human observer, even though—when resolved temporally—different light colours are displayed in succession and/or the different light colours are emitted in succession, in a manner staggered over time and particularly without overlap. The mixed colour is therefore produced by means of time-division multiplexing of the different light colours. The production of the mixed colour is based on the fact that particularly a human observer is unable to resolve changes at a frequency of greater than 30 hertz or 50 hertz, for example, and instead the different light colours are visually accumulated and integrated.

The time-division multiplexing of the colour groups therefore allows a flexible LED lighting apparatus to be implemented that firstly allows a colour mixing mode and secondly requires only a few components on account of the supply voltage with a rectified AC voltage.

In a preferred embodiment, the control device is designed to actuate the colour mixing unit such that no more than just precisely one colour group is activated at the same time or simultaneously in each case. This embodiment once again emphasises the inventive concept of activating the colour groups in succession and in this embodiment preferably exclusively alternatively in order to produce the mixed colour during the colour time window.

In a preferred development of the invention, for a mixed colour that needs to be produced from at least two colour groups in the colour time window, at least or precisely one changeover operation between the colour groups is effected during a colour time window. Particularly preferably, the number of changeover operations for a mixed colour that is produced from light colours in all colour groups corresponds to the number of colour groups minus 1 in order to keep the changeover operations at a minimum. In a further embodiment, no more than one, that is to say precisely one or no, changeover operation is effected in a half-cycle.

It is particularly preferred that the colour mixing frequency is in a form greater than 30 hertz, preferably greater than 50 hertz, in order to avoid flicker, particularly colour flicker, for the human observer.

In a first possible embodiment of the invention, the colour mixing frequency corresponds to the voltage frequency and/or the colour time window is in a form with the same temporal length as one of the half-cycles. This embodiment is particularly simple to realize, since the planning of the changeover operations needs to take account of only a single half-cycle, which is then repeated at the colour mixing frequency and/or the voltage frequency.

Optionally, provision may be made for the half-cycles and the colour time windows to be arranged in temporarily synchronized form, but in a manner staggered over time in relation to one another by an, in particular, fixed and/or constant phase angle. It is thus not necessary for the mixed colour to be produced within one half-cycle, it being possible by contrast, for the mixed colour to be realised by the second half of a first half-cycle and by the first half of a subsequent second half-cycle. This allows changeover operations to be placed in minima in the supply voltage, which are arranged between the half-cycles, for example, so that at least some of the changeover operations can be effected in the zero-voltage state of the colour mixing unit.

Taking account of the advantages of a cleverly chosen phase angle, it is preferred for the phase angle to be chosen on the basis of the mixed colour. This means that different strategies for positioning the changeover operations in time can be implemented by virtue of the phase angle being chosen freely and/or the phase angle being chosen on the basis of the mixed colour. A first possible strategy is to maximize the number of changeover operations at the voltage minima in the supply voltage. A second possible strategy is to place the changeover operations into low-voltage areas of the half-cycles, since a random time shift or timing jitter has only little influence on the mixed colour on account of the low power that is output in the low-voltage areas.

In another embodiment of the invention, the colour mixing frequency is lower than the voltage frequency, in particular the voltage frequency is an integer multiple of the colour mixing frequency, or—expressed in alternative terms—the colour time window is in a form with greater temporal length than one of the half-cycles. In this embodiment of the invention, the mixed colour is produced by colour components of the colour group that are distributed over more than one successive half-cycle. In this way, the notional tie of the identical length of half-cycle and colour time window is relinquished. In this embodiment, there can be a better discussion of the voltage field, which firstly involves the changeover operations and/or the colour mixing frequency being kept so fast or high that the human observer cannot perceive any colour flicker, and at the same time the changeover operations being implemented at a frequency that is as low as possible, since the changeover operations can mean firstly instabilities and secondly short dark phases.

It is particularly preferred that a quotient between the voltage frequency and the colour mixing frequency and/or between the temporal length of the colour time window and the temporal length of the half-cycle is in the form of a rational number. Hence, ratios such as 2:1, 3:1, 3:2, 4:1, 4:2, 4:3, etc., can be implemented. Particularly preferably, the value of the voltage frequency is an integer multiple of the value of the colour mixing frequency and/or the length of the colour time window is an integer multiple of the temporal length of the half-cycle.

Expressed in more general terms, it is preferred that a number of X successive colour time windows have an associated number of Y successive half-cycles. In this case, the X colour time windows define a colour period, and the Y half-cycles define a voltage period, wherein the colour period and the voltage period are in a form with the same length. However, it is possible for colour period and voltage period to be arranged in relation to one another in a manner staggered over time in relation to one another by a fixed and/or constant phase angle.

In this situation too, however, it is possible for the phase angle to be dependent on the mixed colour. Thus, particularly preferably, the number of colour groups, the number of colour time windows within the colour period and the number of half-cycles within the voltage period are chosen such that only one changeover operation is needed per half-cycle in order to produce the mixed colour. By way of example, the LED lighting apparatus has three different colour groups, with the colour time window extending over three half-cycles. With customarized selection of the phase angle, the effect that can be achieved is that only one changeover operation is needed in each half-cycle in order to achieve any desired mixed colour from the three colours. As an optional addition, provision may be made for the phase angle to be chosen such that the changeover operations are accommodated at the beginning of a half-cycle, for example within the first 30% of the temporal length of a half-cycle, since the voltage is very low in this period of time and this means that any time shifts in the changeover operation are not distinctly perceptible in the mixed colour.

In a further preferred embodiment of the invention, an alteration in the phase angle between colour period and voltage period or between colour time window and half-cycle takes place over the course of time. During a first colour period or during a first colour time window, colour period and voltage period or colour time window and half-cycle have a first phase angle. During a subsequent second colour period, colour period and voltage period or colour time window and half-cycle have a second phase angle, which is different there-from. The second phase angle may be less than or greater than the first phase angle. Such a phase shift is achieved by virtue of corresponding decrease or increase in the duration of the colour period or of the colour time window in comparison with the duration of the voltage period or the half-cycle. Since the duration of the half-cycle or of the voltage period is usually firmly prescribed by the power supply system, a phase shift is effected by alteration, that is to say decrease or increase, of the duration of the colour time window.

In a preferred embodiment of the invention, the LED lighting apparatus comprises a switching arrangement, wherein the switching arrangement is designed to put the LEDs in a colour group into at least two switching states, wherein the switching states differ by virtue of the on-state voltage (not equal to 0V) of the colour group. The different on-stage voltages of the switching states are achieved by virtue of the LEDs being connected in series or parallel with one another on the basis of the switching state in order to change the on-state voltage. If two LEDs that each have a forward voltage of 3.4 volts are connected in series, for example, then the collective on-state voltage is 6.8 volts. If they are connected in parallel, the on-state voltage is just 3.4 volts. On the basis of these systematics, the LEDs can also be connected in subgroups—in parallel and in series—in order to achieve the different on-state voltages.

In a preferred development of the invention, the control device is designed to actuate the colour groups in the event of activation such that a switching state with an on-state voltage is activated, wherein the on-state voltage is less than or equal to the instantaneous value of the supply voltage. This is achieved particularly by virtue of the LED light unit, particularly the switching arrangement, being actuated at least twice, preferably at least four times, per half-cycle in order to change the switching state and hence the on-state voltage.

Particularly preferably, the control device is designed to activate that switching state in the circuit arrangement that has the highest on-state voltage that is less than or equal to the instantaneous value of the supply voltage.

If a colour time window that comprises at least or precisely one half-cycle is considered, then at the beginning of the half-cycle a colour group in a switching state with an on-state voltage that is lower than the instantaneous value of the supply voltage is activated. Over the further course of time, either—when the instantaneous value of the supply voltage is rising—the switching state of the colour group is changed, so that the latter has a higher on-state voltage, or there is a switch to another colour group, this other colour group again having a switching state with an on-state voltage that matches the instantaneous value of the supply voltage. The effect achieved by this is that an LED lighting apparatus with a rectified AC voltage as supply voltage can emit a constant or more or less constant mixed colour.

The LED lighting apparatus is particularly in the form of a lamp. In particular the colour mixing unit emits a uniform or extensive light.

In a possible development, the LED lighting apparatus has a switch-on module, wherein the switch-on module is designed to produce a constant phase offset between the voltage frequency and the colour mixing frequency when the LED lighting apparatus is switched on. The phase offset can be produced by means of a random function, for example. Alternatively, the phase offset can be produced on the basis of individual properties of the LED lighting apparatus, such as MAC-ID or the like. The phase offset can assume any value or be an integer multiple of the period of the voltage frequency. The advantage of the switch-on module is that when a plurality of LED lighting apparatuses of the same design are switched on in parallel they are purposefully taken out of phase, so that improved colour mixing is achieved in a room lit by the plurality of LED lighting apparatuses.

A further subject of the invention relates to a method for operating the LED lighting apparatus as has been described previously. The control device selectively activates and deactivates the colour groups, so that a mixed colour is produced, wherein the colour groups are actuated within a colour time window such that they are activated in succession in order to produce the mixed colour during the colour time window. The colour time window is continually repeated for a constantly selected mixed colour.

BRIEF DESCRIPTION OF THE DRAWINGS

Further features, advantages and effects of the invention will emerge from the description that follows for preferred exemplary embodiments of the invention and from the appended figures, in which.

DETAILED DESCRIPTION OF THE INVENTION

Figure 1:
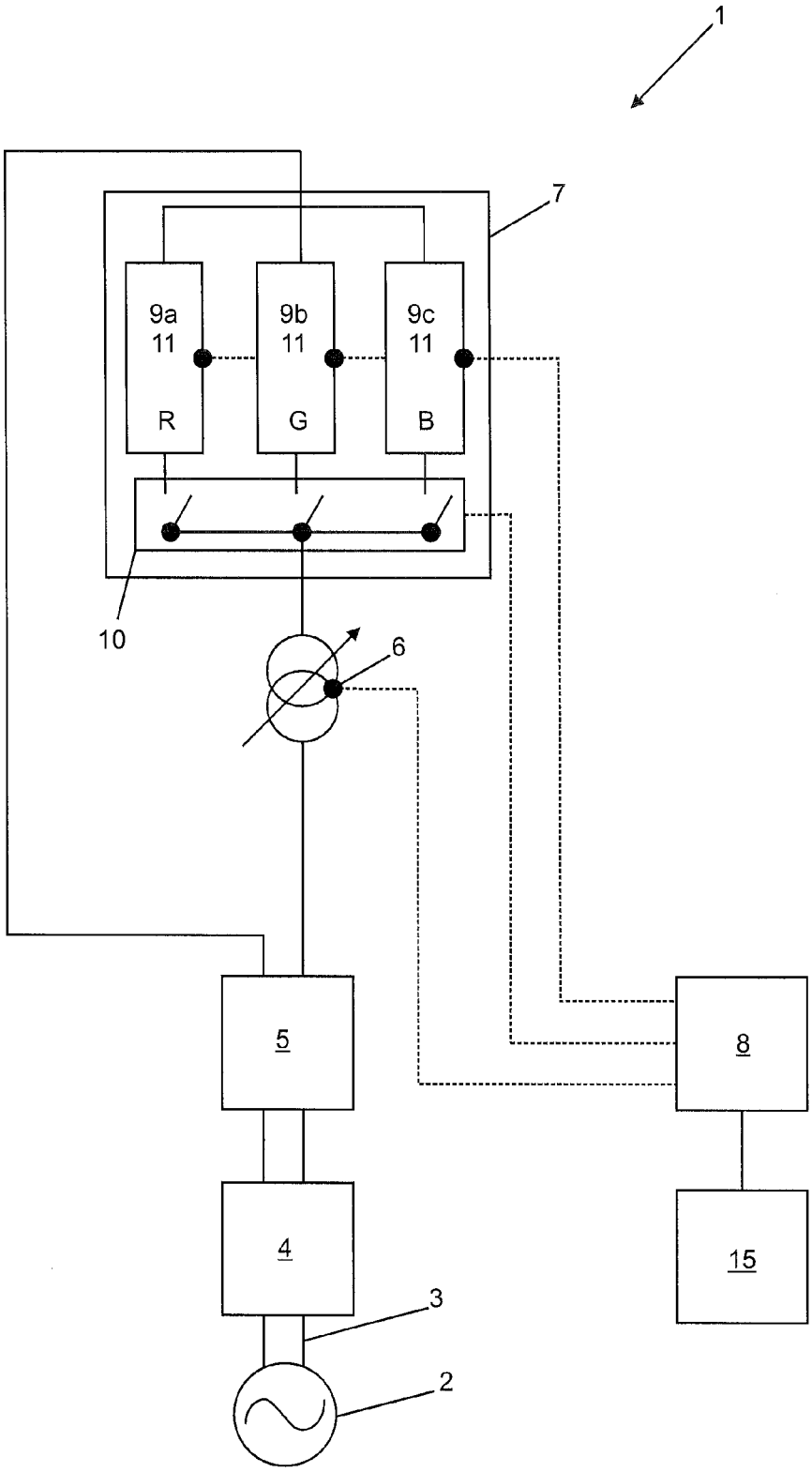
FIG. 1 shows a schematic block diagram of an LED lighting apparatus as an exemplary embodiment of the invention.

FIG. 1 shows a schematic block diagram of an LED lighting apparatus 1 as a first exemplary embodiment of the invention, which can be arranged or is arranged in an aircraft as passenger space lighting. By way of example, the LED lighting apparatus 1 is in the form of a surface luminaire or in the form of indirect lighting for lighting a ceiling of the passenger space in the aircraft.

The aircraft provides an AC power supply 2 having an AC voltage. The RMS voltage of the AC voltage is 115 volts, for example, and the frequency of the AC power supply 2 is between 150 hertz and 400 hertz. Both the RMS voltage and the frequency of the AC voltage can fluctuate to a great extent during operation.

A connection interface 3 for coupling the LED lighting apparatus 1 to the AC power supply 2 is optionally followed by a mains filter 4, which is designed to filter perturbations that could be fed back into the AC power supply 2.

The mains filter 4 has a rectifier 5 connected downstream of it, which is designed to convert the applied AC voltage or the filtered AC voltage into a rectified AC voltage as a supply voltage. By way of example, the rectifier 5 is in the form of a bridge rectifier. The supply voltage is in the form of a rectified AC voltage, particularly in the form of a pulsed DC voltage, with temporarily successively half-cycles. By way of example, the supply voltage is formed by juxtaposition of sinusoidal half-cycles at twice the frequency of the AC voltage of the AC power supply 2. The repetition rate of the half-cycles of the supply voltage defines a voltage frequency.

The supply voltage provided by the rectifier 5, or the corresponding supply current, is subsequently forwarded to a current sink device 6—also called an electronic load. The current sink device 6 is designed to draw current and hence power from the circuit in regulated or controlled fashion by converting it into heat. From the current sink device 6, an LED voltage and an LED current are forwarded to a colour mixing unit 7.

The LED lighting apparatus 1 additionally comprise a control device 8 that, as shown in this case, can be of single-part or alternatively multi-part design and that is at least designed to actuate the colour mixing unit 7 and the current sink device 6. The control device 8 may be in the form of a programmable microcontroller, for example.

As an input signal, the control device 8 is provided with the supply voltage or the AC voltage or an equivalent or synchronized signal. The colour mixing unit 7 can be controlled by the control device 8 so as firstly to be able to be matched to different amplitudes of the supply voltage and secondly to be able to produce different mixed colours.

The colour mixing unit 7 comprises three colour groups 9*a, b, c*, each of the colour groups 9*a, b, c* having a plurality of LEDs (light-emitting diodes), with the LEDs in the colour groups 9*a, b, c* differing by virtue of the light colour. By way of example, the colour group 9*a* has only red (R) LEDs, the colour group 9*b* has only green (G) LEDs and the colour group 9*c* has only blue (B) LEDs. By way of example, each of the colour groups 9*a, b, c*, comprises at least three, preferably at least six, LEDs in a light colour.

In order to produce a mixed colour, the LED lighting apparatus 1 and particularly the colour mixing unit 7 comprises a device 10 for changing over the colour groups 9*a, b, c*, wherein the device 10 can be actuated by the control device 8, so that the control device 8 can use the device 10 to selectively activate and deactivate the colour groups 9*a, b, c*. The device 10 may—as FIG. 1 shows—be in the form of a separate device, and alternatively may also be integrated in the colour groups 9*a, b, c*. When considered from a functional point of view, it is possible for the actuation via the control device 8 to control the device 10 such that the colour mixing unit 7 produces a mixed colour.

In addition, the colour groups 9*a, b, c*, each comprise a switching arrangement 11 that allows the colour groups 9*a, b, c* to be switched to different switching states by means of the control device 8 in order to be able to react to different amplitudes of the supply voltage.

Figures 2A, 2B, 2C:
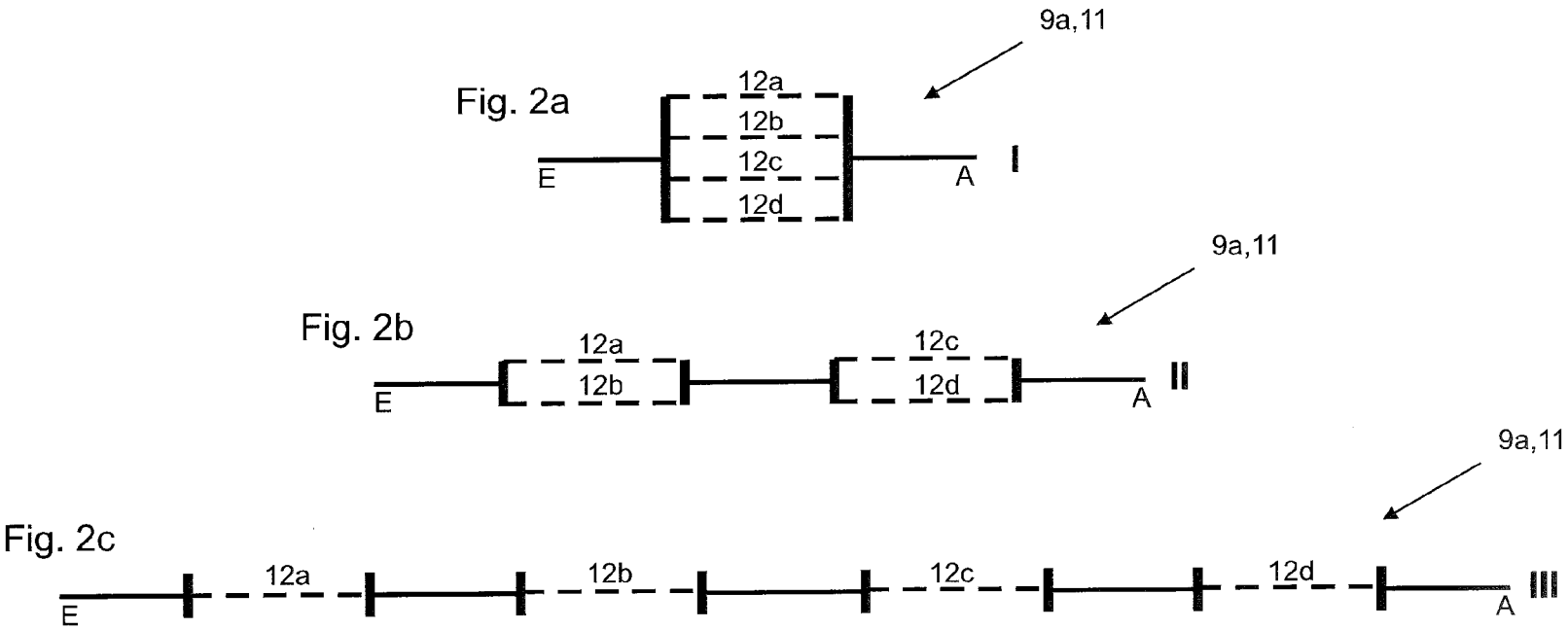
FIGS. 2A, B and C show colour groups from the LED lighting apparatus in FIG. 1 in various switching states.

FIG. 2A shows one of the colour groups—in this example the colour group 9*a*—with a switching arrangement 11 in a highly schematic illustration by way of example. The colour group 9*a* comprises an input E and an output A or a first and a second pole, by which the colour group 9*a* is connected to the power supply shown in FIG. 1.

In this example, the colour group 9*a* comprises four LED subgroups 12*a, b, c, d*, each LED subgroup 12*a, b, c, d* having at least one LED. In particular, each LED subgroup 12*a, b, c, d* has the same on-state voltage—also called forward voltage. The LEDs in the LED subgroups 12*a, b, c, d* may—as shown symbolically in FIGS. 2A, B, C—be connected in series with one another in each of the LED subgroups 12*a, b, c, d*. In modified exemplary embodiments, the LEDs in the LED subgroups 12*a, b, c, d* may also be connected up to one another in parallel, in series or in a mixture of in parallel and in series. In this exemplary embodiment, each LED subgroup 12*a, b, c, d* has the same on-state voltage. The four LED subgroups 12*a, b, c, d* are arranged in electrical parallel with one another in the first switching state I—shown in FIG. 2A—of the colour group 9*a*, so that the on-state voltage of the colour group 9*a* corresponds to the on-state voltage of one of the LED subgroups 12*a, b, c, d*.

FIG. 2B shows a second switching state II, wherein the LED subgroups 12*a, b, c, d* in the colour group 9*a* are connected to one another in electrical series only in part. By way of example, in the first group the LED subgroups 12*a, b* are arranged in parallel with one another and in the second group the LED subgroups 12*c, d* are likewise arranged in parallel with one another, but the two groups are arranged in series with one another. In the switching state II, the on-state voltage of the colour group 9*a* now corresponds to twice the on-state voltage of one of the LED subgroups 12*a, b, c, d*.

FIG. 2C shows a third switching state III, all four LED subgroups 12*a, b, c, d* now being arranged in electrical series with one another. The on-state voltage of the colour group 9*a* now corresponds to four times the on-state voltage of one of the LED subgroups 12*a, b, c, d*.

The circuit arrangement 11 is designed to switch the colour group 9*a* to the different switching states I, II, III. An appropriate circuit arrangement 11 for this type of changeover can be realized using diodes and transistors, for example.

The type of changeover to different switching states is not limited to the example described, however, but rather can also be achieved, by means of other circuit arrangements, such as the LED lighting apparatuses cited in the introduction. It is also possible for the LED subgroups 12*a, b, c, d* to be deactivated in the switching states.

The other colour groups 9*b, c* can likewise have circuit arrangements 11, as a result of which these colour groups 9*b, c* can also be put into different switching states with different on-state voltages. The selection of the switching states is made by the control device 8. In particular, it is possible for the device 10 to be integrated in the circuit arrangements 11.

Figure 3:
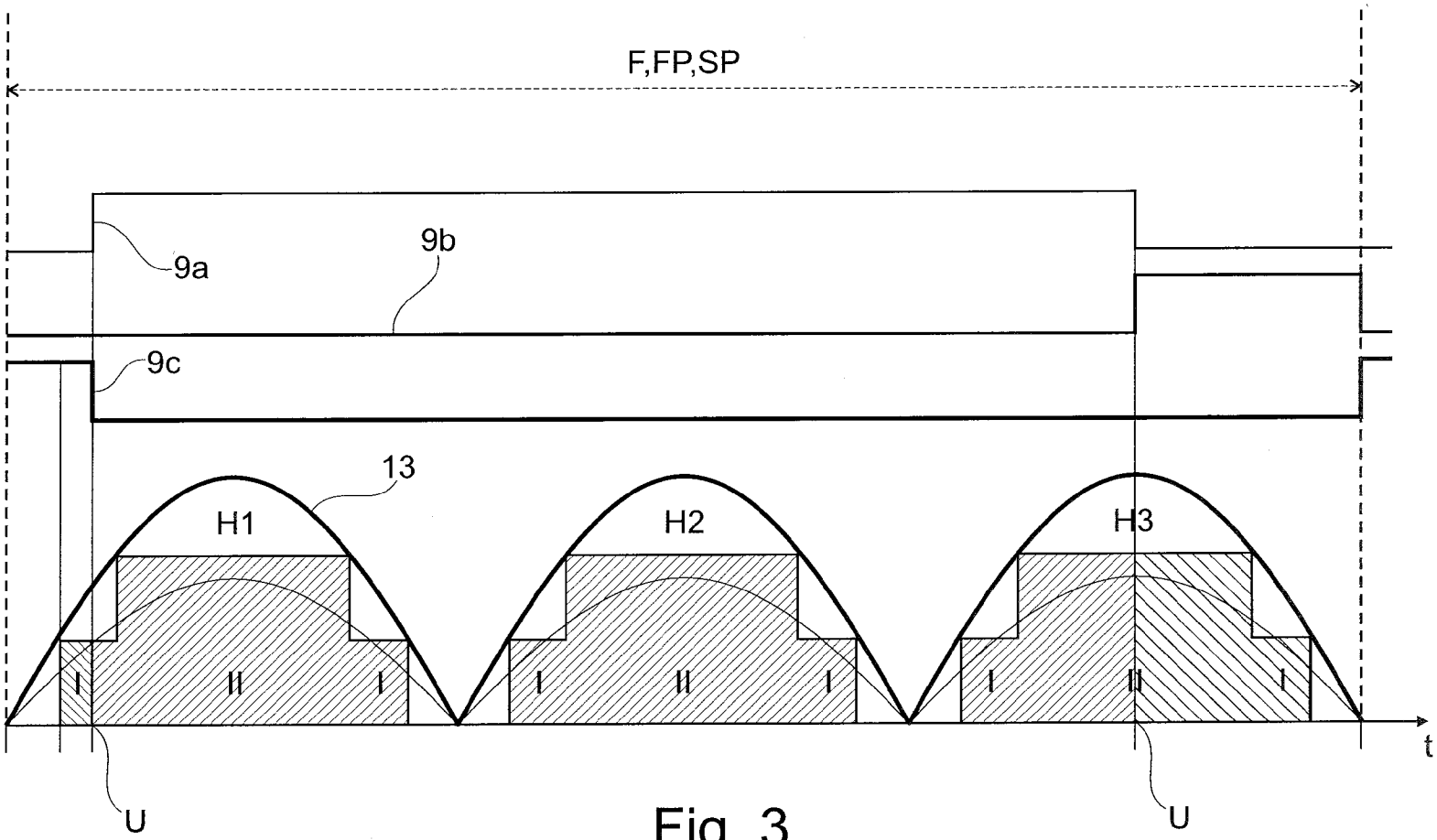
FIG. 3 shows a graph to explain the synchronization of the activation and deactivation of the colour groups in FIG. 1.

In FIG. 3, half-cycles H1, H2, H3 of the supply voltage 13 are plotted over time t in a highly schematic fashion, the figure showing that the switching states I, II—initially considered independently of a light colour—are always chosen such that the on-state voltage is lower than an instantaneous value of the supply voltage 11. On the other hand, the colour mixing unit 7 is always set to the switching state that has the maximum on-state voltage in order to minimize power losses.

Without further measures, the LED current and, as a result of that, the supply current and ultimately the mains current would lead to a mains current profile that is characterized by inhomogeneities and spikes, owing to the changeover operations in the colour mixing unit 7. However, in order to achieve a high power factor of greater than 0.99, for example, the control device 8 actuates the current sink device 6 such that the supply current and hence the mains current has a profile in sync with the supply voltage or in sync with the AC voltage or with the mains voltage. In particular, during normal operation, the current sink device 6 is actuated to convert current and hence power into heat in order to keep the power factor high.

FIG. 3 schematically shows that the switching state I is adopted until the supply voltage 13 has reached a value above the on-state voltage of the switching state II. The colour mixing unit 7 is then changed over, so that the switching state II is used. It would also be possible to activate a third switching state III. Following the maximum of the half-cycle, the supply voltage 13 falls, and as soon as it is below the on-state voltage of the switching state II the colour mixing unit 7 is changed over to the switching state I. It can also be seen that as soon as the instantaneous value of the supply voltage 13 is below the on-state voltage of the switching state I the colour mixing unit 7 is deactivated completely—for example by a shorting device—, since the instantaneous value of the supply voltage 13 is no longer sufficient. In these phases, the supply current is converted into heat in the current sink device 6, so that the power factor remains high. The profile of the supply current 14 is therefore always in sync with the supply voltage 13.

In order to produce a mixed colour using the colour mixing unit 7, time-division multiplexing is implemented, with the colour groups 9*a, b, c* being activated serially in succession and exclusively alternatively and/or alternatively activated and deactivated. In particular, only a single colour groups 9*a, b* or *c* is active each time.

The LED lighting apparatus 1 comprises a control device 15 that allows the selection of a mixed colour for the colour mixing unit 7. The mixed colour is produced by virtue of the colour groups 9*a, b, c* being activated in succession within a colour time window F, so that the light perceived by a user is a mixed colour. In order to produce any desired colour that can be achieved in the RGB colour space, the components of the activation times for the colour groups 9*a, b, c* within the colour time window F can be set by the control device 15. Thus, in the example shown in FIG. 3, first the colour group 9*c* is activated in the first half-cycle H1, then the colour group 9*a* from the first half-cycle H1 to the third half-cycle H3, and at the end of the third half-cycle H3 the colour group 9*b* is activated.

Hence, during the colour time window F, the timing of which comprises at least one half-cycle, in this example three half-cycles H1, H2, H3, the colour groups 9*a, b, c*, and thus all of the colour groups 9*a, b, c* of the LED lighting apparatus 1 are activated in succession.

Figure 4A:
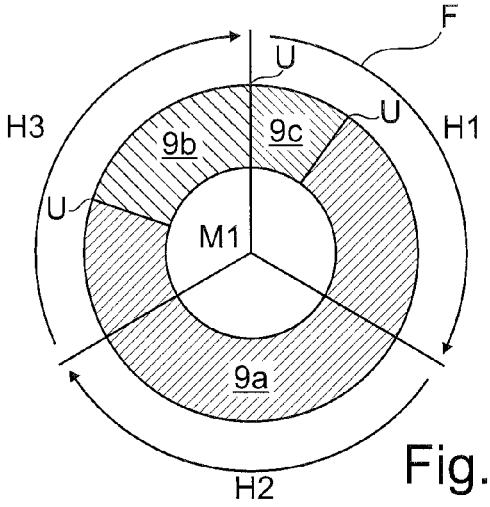
FIGS. 4A, B and C each show a pie chart to explain the setting of a mixed colour.

FIGS. 4A, B, C show different mixed colours M1, M2, M3, the mixed colours M1, M2, M3 being produced by different time components for the colour groups 9*a, b, c* within the colour time window F. In the circular representation, the colour time window occupies 360° and the half-cycles H1, H2, H3 each occupy 120°. Thus, for the transitions from the mixed colour M1 to the mixed colour M2, for example, the green component is raised by extending the activation time for the colour group 9*b* and the red component is lowered by shortening the activation time for the colour group 9*a*. Changeover of the colour groups 9*a, b, c* involves a respective changeover operation U.

The changeover operations U are placed such that only one respective changeover operation U is implemented per half-cycle H in order to keep down switching time losses. This is made possible by virtue of the colour time window F being shifted through a phase angle in comparison with the half-cycles H1, H2, H3, as indicated in FIG. 4C in comparison with FIG. 4B, in order to shift the timing of the changeover operations U relative to the half-cycles H1, H2, H3.

In FIG. 4A, B, the colour time window F has a first phase angle, which in this case is 0°, relative to the half-cycles H1, H2, H3 and hence relative to the voltage period SP defined by the three half-cycles H1, H2, H3, as a result of which the colour time window F and the three half-cycles H1, H2, H3 have no phase shift.

Figure 4B:
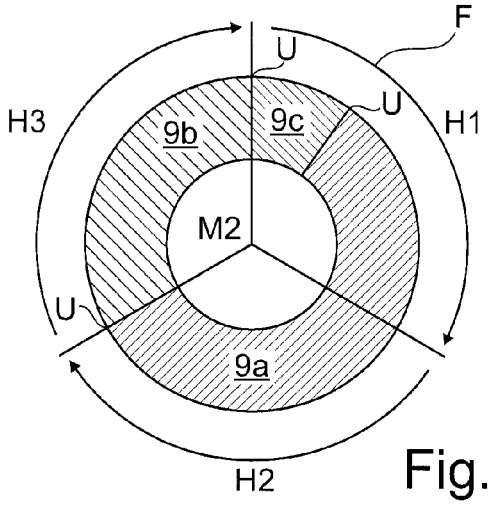
Figure 4C:
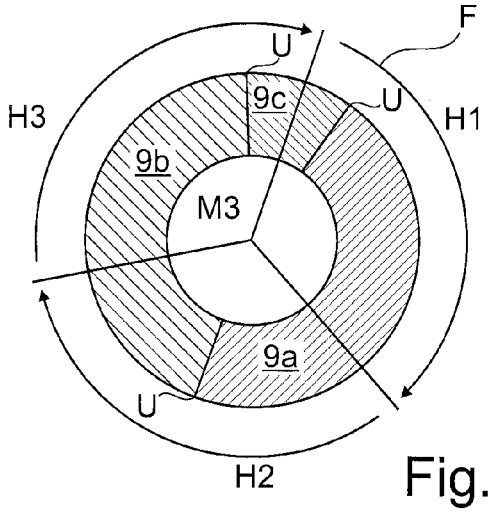

In FIG. 4C, the colour time window F and the half-cycles H1, H2, H3 have a phase angle that is different from 0°. Such a phase shift is attained by appropriately changing the duration of the colour time window F relative to the duration of the half-cycles H1, H2, H3 or relative to the duration of the voltage period SP. Following such a transition in the state from FIG. 4B to the state in FIG. 4C, the phase angle between the colour time window F and the half-cycles H1, H2, H3 again remains constant. This means that before and after such a transition the duration of the colour time window F corresponds to the duration of the voltage period SP. In the state shown in FIG. 4C, the phase angle between colour time window F and voltage period SP is then again constant, but—in contrast to the state shown in FIG. 4B—not equal to zero.

Returning to FIG. 3, it is shown that the colour time window F forms a colour period FP in the three half-cycles form a voltage period SP, the colour period FP and the voltage period SP being in a form with the same length, being shifted through a phase angle of 0° in FIG. 3, and also being able to be arranged in manner staggered over time in relation to one another by a phase angle not equal to 0°, as shown in FIG. 4B, for example.

LIST OF REFERENCE SYMBOLS

1 Lighting apparatus
2 AC power supply
3 Connection interface
4 Mains filter
5 Rectifier
6 Current sink device
7 Colour mixing unit
8 Control device
9*a, b, c* Colour groups
10 Device
11 Switching arrangement
12*a, b, c, d* LED sub groups
13 Supply voltage
14 Supply current
15 Control device
I First switching state
II Second switching state
III Third switching state
A Output
E Input
F Colour time window
H1, H2, H3 Half-cycle
M1, M2, M3 Mixed colours
U Changeover operation

What is claimed is:

1. An LED lighting apparatus comprising:

a colour mixing unit, wherein the colour mixing unit comprises at least a first colour group of LEDs and a second colour group of LEDs, wherein the LEDs in the colour groups differ by virtue of the light colour;

a power supply for supplying a supply voltage to the colour mixing unit, wherein the supply voltage is in the form of a rectified AC voltage, wherein a repetition rate of half cycles of the supply voltage defines a voltage frequency; and a control device for selectively activating and deactivating the colour groups, wherein the colour mixing unit produces a mixed colour by means of the selectively activated and deactivated colour groups, wherein a repetition rate of a colour time window defines a colour mixing frequency, wherein the control device is configured to actuate the colour groups, such that the colour groups are activated within the colour time window in succession to produce the mixed colour during the colour time window.

2. The LED lighting apparatus according to claim 1, wherein no more than a single colour group is activated at the same time in the colour mixing unit within the colour time window.

3. The LED lighting apparatus according to claim 1, wherein for a mixed colour, at least one changeover operation between the colour groups is effected during the colour time window.

4. The LED lighting apparatus according to claim 1, wherein the colour mixing frequency is greater than 30 hertz.

5. The LED lighting apparatus according to claim 1, wherein the colour mixing frequency corresponds to the voltage frequency or wherein the colour time window is in a form with the same temporal length as one of the half-cycles.

6. The LED lighting apparatus according to claim 1, wherein the half-cycles and the colour time windows are arranged in a manner staggered over time in relation to one another by a phase angle.

7. The LED lighting apparatus according to claim 6, wherein the phase angle is chosen on the basis of the mixed colour.

8. The LED lighting apparatus according to claim 1, wherein the colour mixing frequency is lower than the voltage frequency or wherein the colour time window is in a form with greater temporal length than one half-cycle.

9. The LED lighting apparatus according to claim 8, wherein the quotient between voltage frequency and colour mixing frequency or the quotient between colour time window and half-cycle is in the form of a rational number.

10. The LED lighting apparatus according to claim 8, wherein the value of the voltage frequency is an integer multiple of the value of the colour mixing frequency or wherein the length of the colour time window is an integer multiple of the value of the temporal length of the half-cycle.

11. The LED lighting apparatus according to claim 8, wherein a number of x successive colour time windows are associated with a number of y successive half-cycles, wherein the x colour time windows form a colour period and the y half-cycles form a voltage period, wherein the colour period and the voltage period are in a form with the same length and arranged or arrangeable in a manner staggered over time in relation to one another by a phase angle.

12. The LED lighting apparatus according to claim 1, further comprising a switching arrangement, wherein the switching arrangement is configured to put the LEDs in a colour group into at least two switching states, wherein the switching states differ by virtue of the on-state voltage of the colour group.

13. The LED lighting apparatus according to claim 12, wherein the control device actuates the colour groups in the event of activation, such that a switching state with an on-state voltage is activated, wherein the on-state voltage is less than or equal to the instantaneous value of the supply voltage.

14. The LED lighting apparatus according to claim 12, wherein the switching state, which has the highest on-state voltage that is less than or equal to the instantaneous value of the supply voltage, is activated.

15. A method for operating the LED lighting apparatus according to claim 1, wherein the control device selectively activates and deactivates the colour groups, so that a mixed colour is produced, wherein the colour groups are actuated within the colour time window, such that the colour groups are activated in succession to produce the mixed colour during the colour time window.

* * * * *